US008176668B2

(12) United States Patent
Simms et al.

(10) Patent No.: US 8,176,668 B2
(45) Date of Patent: May 15, 2012

(54) RECOIL REDUCER FOR USE WITH A FIREARM

(75) Inventors: Nathan Simms, Glade Park, CO (US); Phil Simms, Glade Park, CO (US)

(73) Assignee: Nathan Simms, Glade Park, CO (US)

( * ) Notice: Subject to any disclaimer, the term of this patent is extended or adjusted under 35 U.S.C. 154(b) by 383 days.

(21) Appl. No.: 12/619,507

(22) Filed: Nov. 16, 2009

(65) Prior Publication Data

US 2010/0122482 A1 May 20, 2010

Related U.S. Application Data

(60) Provisional application No. 61/199,479, filed on Nov. 17, 2008.

(51) Int. Cl.
*F41C 23/06* (2006.01)

(52) U.S. Cl. ..... 42/1.06; 42/74

(58) Field of Classification Search ..... 42/1.06, 42/71.01, 73, 74, 85, 99
See application file for complete search history.

(56) References Cited

U.S. PATENT DOCUMENTS

| | | | | | |
|---|---|---|---|---|---|
| 837,601 | A | * | 12/1906 | Behr | 42/74 |
| 935,163 | A | * | 9/1909 | Parker | 42/74 |
| 3,039,222 | A | * | 6/1962 | Hoge | 42/74 |
| 3,176,424 | A | * | 4/1965 | Hoge | 42/74 |
| 3,461,589 | A | * | 8/1969 | Vironda | 42/74 |
| 3,492,749 | A | * | 2/1970 | Vironda | 42/74 |
| 3,707,797 | A | * | 1/1973 | Ruth | 42/74 |
| 3,938,851 | A | | 2/1976 | Shelby et al. | |
| 4,079,525 | A | | 3/1978 | Linton et al. | |
| 4,088,377 | A | | 5/1978 | Corrigan | |
| 4,439,943 | A | * | 4/1984 | Brakhage | 42/74 |
| 4,663,877 | A | * | 5/1987 | Bragg | 42/74 |
| 4,769,937 | A | * | 9/1988 | Gregory et al. | 42/74 |
| 4,785,922 | A | | 11/1988 | Kiehart | |
| 4,938,116 | A | | 7/1990 | Royster | |
| 5,031,348 | A | * | 7/1991 | Carey | 42/74 |
| H1010 | H | | 1/1992 | Kasten et al. | |
| 5,127,310 | A | | 7/1992 | Lishness et al. | |
| 5,164,534 | A | | 11/1992 | Royster | |
| 5,392,553 | A | * | 2/1995 | Carey | 42/73 |
| 5,392,689 | A | | 2/1995 | Buzzeo et al. | |
| 5,410,833 | A | | 5/1995 | Paterson | |
| 5,519,957 | A | | 5/1996 | Iannetta | |
| 5,979,098 | A | | 11/1999 | Griggs | |
| D454,610 | S | | 3/2002 | McCarthy | |
| D456,872 | S | | 5/2002 | McCarthy | |
| D462,104 | S | | 8/2002 | McCarthy | |
| 6,481,142 | B1 | | 11/2002 | McCarthy | |

(Continued)

*Primary Examiner* — Michael Carone
*Assistant Examiner* — Jonathan C Weber
(74) *Attorney, Agent, or Firm* — E. Victor Indiano; Indiano Law Group, LLC

(57) ABSTRACT

A recoil reducer device for use with a firearm is provided, that is movable between a rest position and a recoil position. The recoil reducer device includes a firearm stock, including a first stock member having a first stock member cavity, and a second stock member having a second stock member cavity. A recoil reducer is receivable in the first and second stock cavities. The recoil reducer includes a shock absorber including a housing and an axially movable plunger. A slider is provided that includes a first slider member fixedly coupled to the shock absorber, and a second slider member movable with respect to the shock absorber and first stock member. A base member is fixedly coupled to the second slider member and a magnet that is magnetically coupled to the base member.

20 Claims, 11 Drawing Sheets

U.S. PATENT DOCUMENTS

| | | | | |
|---|---|---|---|---|
| 6,481,143 | B2 | 11/2002 | McCarthy | |
| 6,684,549 | B2 * | 2/2004 | Bragg | 42/74 |
| 7,380,487 | B2 * | 6/2008 | Mantras | 42/74 |
| 7,493,845 | B2 | 2/2009 | Mantas | |
| 2002/0053156 | A1 * | 5/2002 | McCarthy | 42/74 |
| 2003/0154640 | A1 * | 8/2003 | Bragg | 42/74 |
| 2006/0048637 | A1 * | 3/2006 | Dimitrios | 42/74 |
| 2008/0196289 | A1 * | 8/2008 | Mantas | 42/1.06 |
| 2009/0126559 | A1 * | 5/2009 | Mantas | 89/44.01 |

* cited by examiner

RECOIL REDUCER FOR USE WITH A FIREARM

I. PRIORITY STATEMENT

The instant application claims benefit of Simms, U.S. Provisional Patent Application No. 61/199,479 that was filed on 17 Nov. 2008, and which is incorporated herein fully by reference.

II. TECHNICAL FIELD OF THE INVENTION

The present invention relates to firearms, and more particularly to a recoil reducer for use in connection with a firearm, to reduce the shock imparted on a user's body by a discharging firearm.

III. BACKGROUND OF THE INVENTION

Firearms have been in use for hundreds of years. The two most popular types of firearms include shoulder-mounted firearms, such as shotguns, rifles, and the like; and hand guns, such as pistols. When a firearm discharges its bullet (or shell), the explosion of the gun powder contained in the bullet or shell casing causes the bullet (or load) to be ejected out of the barrel of the pistol or rifle at a high velocity.

Along with the force of the bullet being shot out of the barrel, there exists a rearwardly directed recoil force that exists in opposition to the forwardly directed force of the bullet. In adherence to Newton's Law, the rearwardly directed force of the recoil is generally proportional to the forwardly directed force of the bullet. Both forces are dependent upon the size and amount of the charge of gun powder in the bullet (or shell), and the size of the bullet (or load) being discharged. Viewed another way, bigger bullets with bigger charges usually create bigger recoils.

Shoulder-mounted guns, such as rifles and shotguns often shoot larger bullets with greater charges than hand guns resulting in the recoil experienced by a user being significant in shoulder-borne weapons.

As the recoil force is directed rearwardly through the stock of a rifle, and onto the shoulder of a user, the force of the recoil has at least two important impacts on the user. First, the force of the recoil will often cause a gun to "jump" to thereby reduce the accuracy of the user's shot. A second impact is that the force of recoil can cause pain to the user's shoulder, especially in cases where the user is shooting a large number of rounds with his rifle, such as when a user is target shooting.

As such, to reduce the pain and fatigue on a user, and to aid in accuracy, various devices have been built to absorb the force of the recoil. These recoil absorbers generally comprise devices where the normal "one-piece" stock of a rifle is replaced with a two-piece stock. Such two-piece stocks usually comprise a proximal stock portion that is disposed close to the firing chamber and barrel; and a distal stock portion that is disposed further away from the firing mechanism, and that usually includes a rearwardly directed end that is placed against the user's shoulder. The first and second stock members are slideably moveable with respect to each other. A shock absorbing recoil reducing mechanism is placed between the first and second stock member to serve as a shock absorber, and to absorb the impact and force of the recoil forces that occur upon the discharge of a firearm. Examples of such known recoil reducers have been invented by McCarthy, including McCarthy, U.S. Design Pat. Nos. D454,610, D456,872, D462,104 and McCarthy, U.S. Pat. Nos. 6,481,142 and 6,481,143.

Additional examples of recoil related mechanisms are shown in the following patents:

Vironda, U.S. Pat. No. 3,451,589 (Aug. 19, 1969)
Mantas, U.S. Pat. No. 7,493,845 (Feb. 24, 2009)
Griggs, U.S. Pat. No. 5,979,098 (Nov. 9, 1999)
Iannetta, U.S. Pat. No. 5,519,957 (May 28, 1996)
Paterson, U.S. Pat. No. 5,410,833 (May 2, 1995)
Buzzeo et al., U.S. Pat. No. 5,392,689 (Feb. 28, 1995)
Shelby et al., U.S. Pat. No. 3,938,851 (Feb. 17, 1976)
Royster, U.S. Pat. No. 5,164,534 (Nov. 17, 1992)
Lishness et al., U.S. Pat. No. 5,127,310 (Jul. 7, 1992)
Kasten et al., U.S. Statutory Invention Registration No. H1010 (Jan. 7, 1992)
Royster, U.S. Pat. No. 4,938,116 (Jul. 3, 1990)
Kiehart, U.S. Pat. No. 4,785,922 (Nov. 22, 1988)
Corrigan, U.S. Pat. No. 4,088,377 (May 9, 1978)
Linton et al., U.S. Pat. No. 4,079,525 (Mar. 21, 1978)

An interesting twist on these devices is the device shown in Linton, U.S. Pat. No. 4,079,525 (21 Mar. 1978). Rather than dealing with a recoil reduction mechanism, Linton relates to a device for simulating the recoil force on a weapon.

Although the devices shown in the above referenced patents, to a greater or lesser extent, likely perform their intended function in a workmanlike manner, room for improvement exists. In particular, room for improvement exists in producing a reliable recoil reducer, that is capable of operating reliably and durably under the extreme forces imposed on the recoil reducer caused by the discharge of the weapon and will function reliably under all weather conditions, including extreme weather conditions. Additionally, room for improvement exists in providing a recoil reduction device that is relatively simple to manufacture, and relatively simple to repair, to thereby enable the user to fix parts that may be broken, and/or to replace parts that may become worn out, without undergoing undue repair efforts.

It is therefore one object of the present invention to provide a recoil reduction that is generally reliable, and easy to manufacture and repair and which is reliable under a variety of weather conditions.

IV. SUMMARY OF THE INVENTION

In accordance with the present invention, a recoil reduction device for use with a firearm is provided, that is movable between a rest position and a recoil position. The recoil reduction device includes a firearm stock, including a first stock member having a first stock member cavity, and a second stock member having a second stock member cavity. A recoil reducer is receivable in the first and second stock cavities. The recoil reducer includes a shock absorber having a housing and an axially movable plunger. A slider is provided that includes a first slider member fixedly coupled to the shock absorber, and a second slider member movable with respect to the shock absorber and first stock member. A base member is fixedly coupled to the second slider member. A magnet is provided that is magnetically coupled to the base member.

In a preferred embodiment of the present invention, the device includes a stock-to-shock coupler for removably fixedly coupling the first stock member to the shock absorber to fixedly position the shock absorber housing with respect to the first stock member when the recoil reducer moves between its rest and recoil positions. Most advantageously, the first stock member includes a passageway aligned with an axis of the shock member, and the stock-to-shock coupler comprises a stock-to-shock fastener that is insertable in the passageway and engageable with the shock absorber to fixedly couple the first stock member to the shock absorber. The stock-to-shock fastener includes an axis disposed co-linearly with an axis of the shock absorber and the recoil reducer.

Additionally, in an preferred embodiment of the present invention, the device includes a magnet mover that is positioned between the shock absorber and the magnet. The magnet mover is moveable to dislodge the magnet from its magnetic engagement with the base member when the recoil reducer moves from its rest position to its recoil position. The magnet and magnet mover are cooperatively positioned to disengage the magnet from the base member as the recoil device begins its movement away from the rest position.

As a corollary, the position of the magnet and magnet mover also helps to maintain the recoil reducer in its rest position, when that is so desired, and the magnet and magnet mover help to add additional resistance to movement of the device away from its rest position. This feature has several advantages. One advantage is that it makes the gun "more steady," and thereby aids the user in aiming the gun, and helps the user to be more accurate with his shooting.

One important use of the present invention is in hunting and in target shooting. In target shooting applications, the accuracy of the user's shot is paramount, as the primary purpose of a target shooting exercise is to determine the most accurate shooter among the contestants. When aiming at a target, the user of the gun helps to reduce the number of variables that can contribute to the inaccuracy of the shot. To that end, users will often time their shot with their breathing and heart beat, so that their breathing and heart beat cycle is at a point where it is less likely to cause the gun to shake, and thereby cause their aim to be off.

Another place where variation can be introduced in a gun with a recoil reducer, is the relative movement of the first and second stock members. In a traditional, "one piece" stock containing gun, this issue is largely irrelevant, because a one piece stock does not have multiple pieces that can move with respect to each other. However, as a stock containing recoil reducer includes a multi-piece stock, the possibility exists that the pieces of the multi-piece stock could move with respect to each other, to thereby induce a movement that may impact the shooter's accuracy. To address this problem, the Applicants' magnet helps to add additional resistance to the movement of either the recoil reducer mechanism, or to the stock members, when the stock member and recoil reducer mechanisms are at its rest position.

One feature of the present invention is that the coupling between the recoil reduction mechanism and the first stock member; the shock absorber plunger of the recoil reduction mechanism; and the coupling member between the second stock member and the recoil reduction mechanism are all disposed on a co-linear axis. This co-linear disposition helps to direct the recoil force along a single line. This single line directed force helps to increase the reliability of the device, by reducing the likelihood of the force being imposed on the recoil system will bend or shake either the coupling members, or the plunger of the shock absorber. Additionally, this co-linearly disposed mechanism helps to provide a very stable mechanism for fixedly coupling the recoil reducer in its proper position, and keeping the recoil reducer in its proper position over a period of time.

Due to the high level of force that is induced on the recoil mechanism by the discharge of a bullet or shotgun shell during firing, the parts within the recoil reduction mechanism are subject to becoming loose or dislodged over time. With the present invention, the co-linear displacement of the various components helps to cause the forces to be directed in a manner that promotes the long term stable position of the recoil mechanism in the stock.

Another advantage of the co-linear placement of the present invention is that it helps to increase the repeatability of the forces exerted by the recoil. By increasing the repeatability of the forces, the user can better compensate for the recoil forces, to thereby enable the user to improve his aim and accuracy, by dealing with a more known and repeatable recoil force, rather than one that is likely to vary. Additionally, the stability of placement imparted by the co-linear arrangement of the present invention helps to reduce the variability that might be induced in the recoil system by the recoil system "giggling" during recoiling and firing.

These and other features and advantages of the present will become apparent to those skilled in the art, upon a review of the drawings and detailed description of the best mode of practicing the invention perceived presently by the Applicants.

V. BRIEF DESCRIPTION OF DRAWINGS

VI. DETAILED DESCRIPTION OF PREFERRED EMBODIMENT

Figure 1:
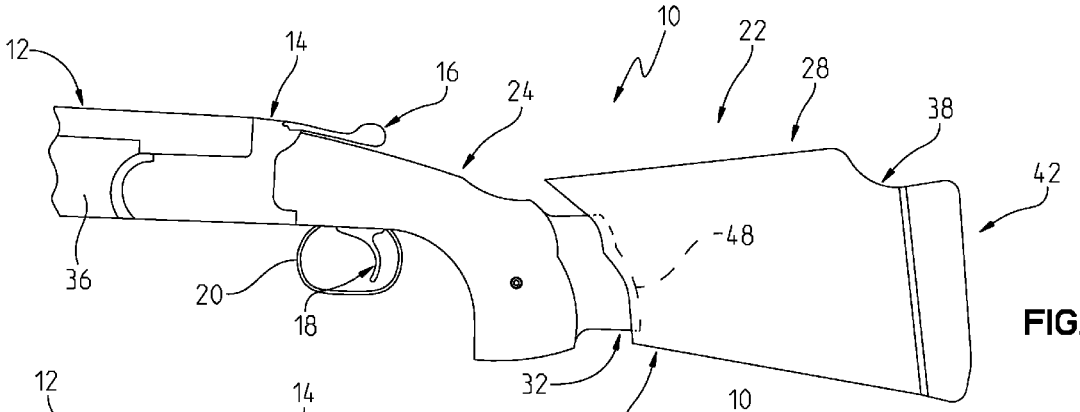
FIG. 1 is a side view of a firearm containing a recoil reducer of the present invention, wherein the recoil reducer is shown in its rest position.
Figure 2:
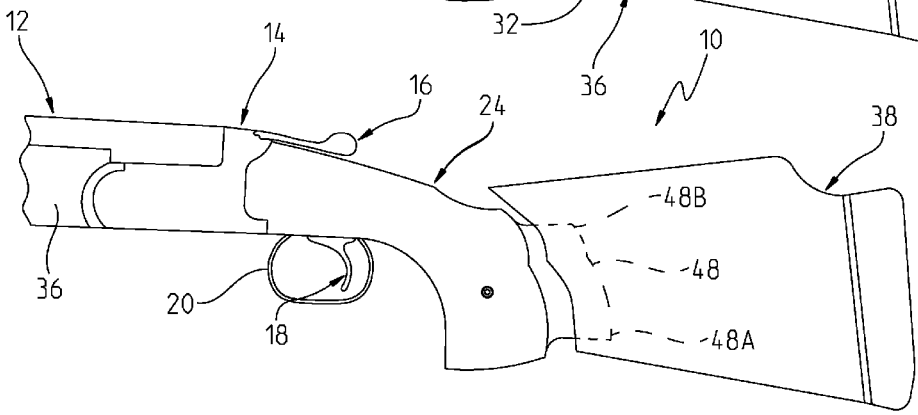
FIG. 2 is a side view of the firearm containing the recoil reducer, similar to FIG. 1, wherein the recoil reducer is shown in its recoil position.
Figure 3:
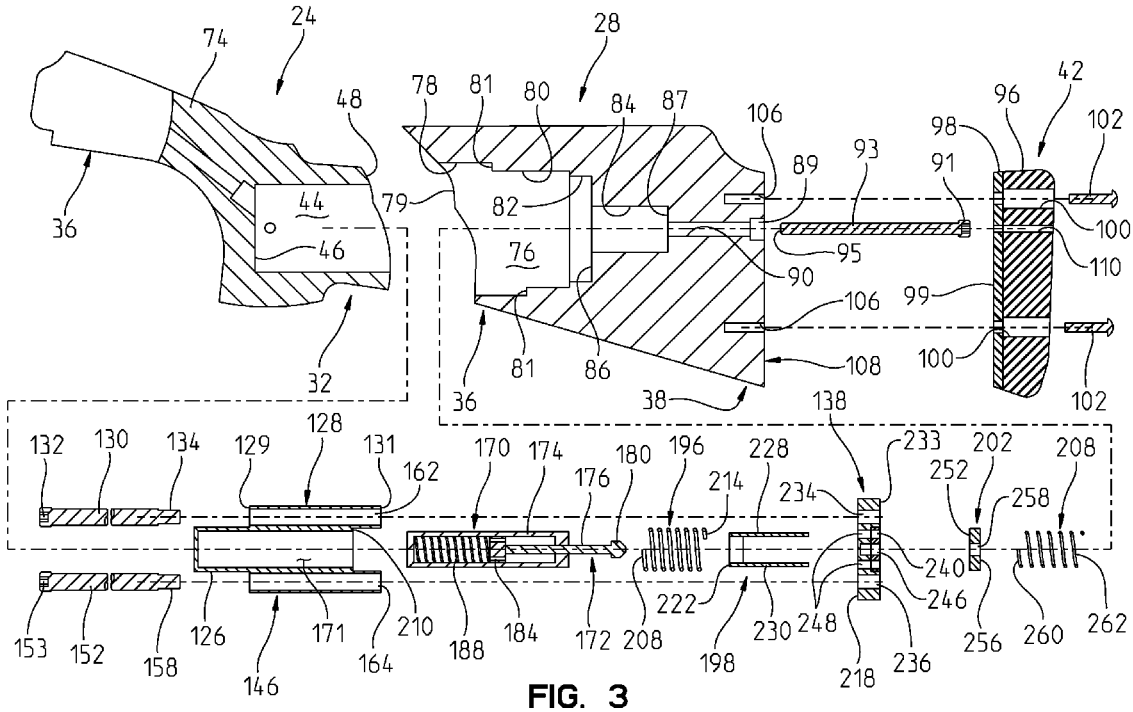
FIG. 3 is an exploded, side sectional view of the recoil mechanism of the present invention, along with the two stock members in which the recoil mechanism resides.

A firearm is shown in the figures, and in particular FIGS. 1-3 that includes a recoil reducer (FIG. 7) of the present invention.

A side, exterior view of the firearm 10 (here shown as a rifle 10) is best shown in FIGS. 1 and 2, as including a barrel 12 that is disposed at one end of the firearm 10 and a generally centrally located firing mechanism 14. The firing mechanism 14 includes a magazine portion for containing bullets or shots, a delivery mechanism for delivering the loaded but unfired bullets to the firing chamber, and a firing chamber. The firing chamber is the portion of the firing mechanism that is disposed at the extreme butt end of the barrel, and is the place where the bullet is held prior to the bullet being fired. The tiring mechanism 14 also includes a hammer 16 for striking the bullet thereby detonating the bullet; and a trigger 18 for actuating the hammer 16. In many rifles, a trigger guard 20 partially encases the trigger 18, to prevent the trigger from either being bent, broken or accidentally actuated, and thereby accidentally firing the firearm.

The stock 22 of the firearm 10 is disposed at the opposite end of the firearm from the barrel 12, and is the portion of the gun 10 that the user grips when firing the gun 10, and that is placed against the user's shoulder in the rifle or shotgun type firearm 10 as shown in the figures.

In the firearm 10 of the present invention with which recoil reducer 11 is used, the stock 22 comprises at least a two piece stock, having a first (proximal) end stock portion 24, and a second (distal) end stock portion 28.

The terms proximal and distal are not used as terms of limitation, but rather terms of direction, that are employed solely to help the reader better understand the relative positioning of the components of the instant invention. It will also be appreciated that terms such as proximal and distal are largely arbitrary, and that the first stock member 24 could just as easily be labeled the distal stock member, The proximal stock member label is so chosen for the first stock member 24, because the first stock member 24 is disposed relatively proximally to the firing mechanism 16. The proximal stock member 24 includes a proximal portion 30, that is disposed adjacent to the firing mechanism, and a distal portion 32, that is disposed relatively away from the firing mechanism 16. When the rifle 10 is being held and the barrel 12 is being pointed forward, the proximal portion 30, will be the forwardly disposed portion of the first stock member 24, and the distal portion 32 will be the more rearwardly disposed portion of the stock member 24.

The second stock member 28 also includes a proximal portion 36 that is disposed close to and adjacent to the distal end 32 of the first stock member 24. The second or distal stock member 28 also includes a distal portion 38, that is disposed at the rear of the rifle 10. The distal portion 38 of the stock terminates in a cushioned pad 42 that is removably fixedly coupled to the distal end of the distal portion 38 of the second stock member 28. The pad 42 is preferably made of a rubber material, to cushion the impact of a recoiling stock 22, against the shoulder of the user.

The first or proximal stock member 24 includes an axially extending proximal cavity 44. The proximal cavity 44 opens at the distal end 32 of the first stock portion 24, and extends between the proximally disposed, radially extending proximal wall 36, and a distal edge 48 of the first stock member 24.

Figure 11:
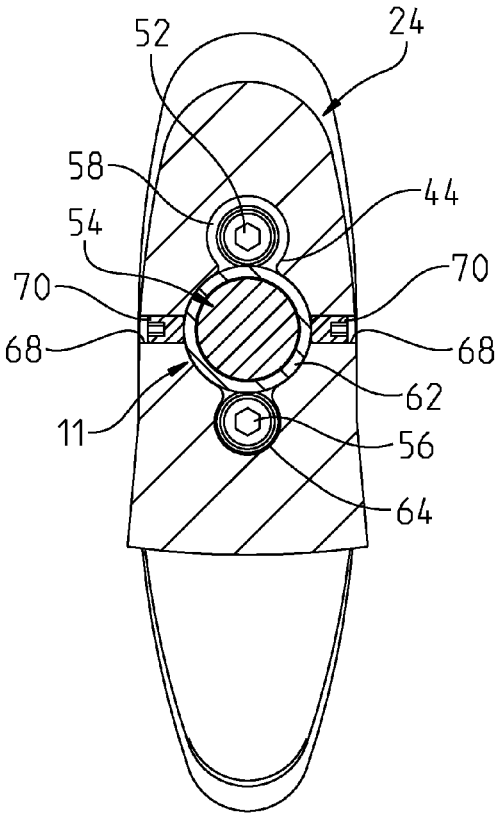
FIG. 11 is a sectional view taken along lines 11-11 of FIG. 6.
Figure 12:
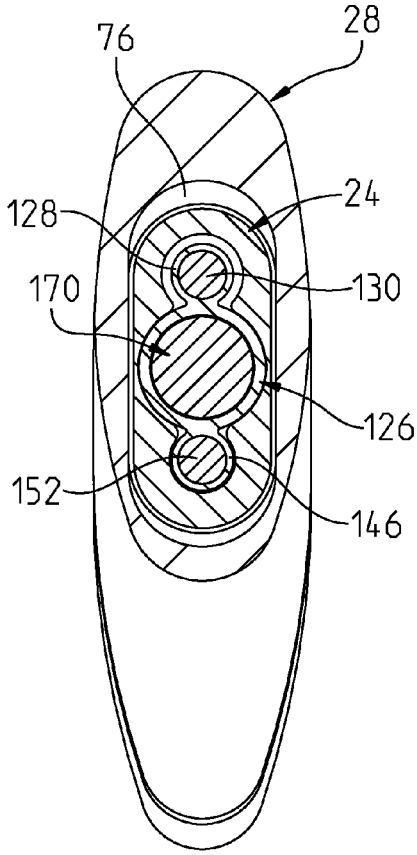
FIG. 12 is a sectional view taken along lines 12-12 of FIG. 6.
Figure 13:
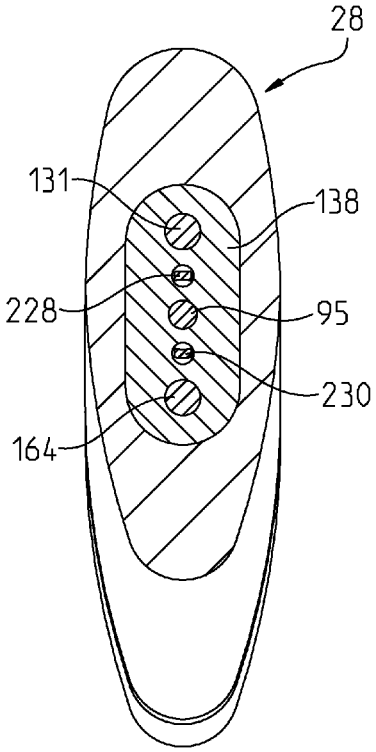
FIG. 13 is a sectional view taken along lines 13-13 of FIG. 6.
Figure 14:
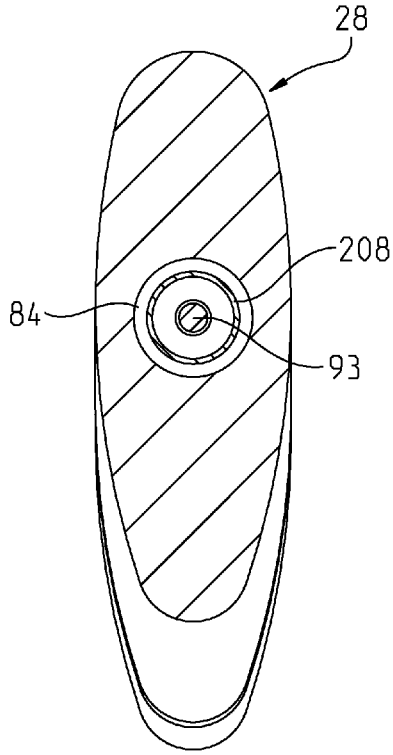
FIG. 14 is a sectional view taken along lines 14-14 of FIG. 6.

As best shown in FIG. 11, the proximal chamber 44 comprises three cylindrical portions, that extend axially, along three generally parallel axes. The three partially cylindrical portions include a first slider receiving portion 58, a shock absorber receiving portion 62, and a second slider receiving portion 64. These various portions 58, 62, 64 are provided for receiving, respectively, the first slider 52, the shock absorber 54 and second slider 56 of the recoil reducer mechanism 11.

The partially cylindrical shape of the three receiving portions 58, 62, 64 were chosen to snugly accommodate the partially cylindrical shapes of the first slider 52, shock absorber 54 and second slider 56. It will be noted that the diameters of the first slider and second slider receiving portions 58, 64 are generally smaller than the diameter of the shock absorber receiving portion 62. This difference in diameters is chosen because the shock absorber 54 of the most preferred embodiment of the present invention has a diameter that is greater than the diameter of the first and second sliders 52, 56, that generally have equal sized diameters. The slider and shock absorber portions 58, 62, 64 should be sized to snugly receive the respective first slider 52, shock absorber 54 and second slider 56, to snugly hold these elements in place, to keep them from moving around or jostling around.

A pair of radially extending threaded passageways 68 can extend radially through the first stock portion 24, and be positioned adjacent to the shock absorber 54, for receiving a pair of retaining screws 70. The retaining screws 70 are designed so that their tips will engage a formed recess in a side of the shock absorber housing 54, to thereby secure the recoil reducer mechanism 11 in place within the first proximal cavity 44, and to prevent axially directed movement of the recoil reducer 11 within the proximal cavity 44.

The radially extending passageway 68 and retaining screw 70, comprise a first stock 24-to-shock 54 coupler that fixedly couples and fixedly position the shock absorber 54, to the first stock member 24, for fixedly relatively positioning the two of them with respect to each other.

Figure 9:
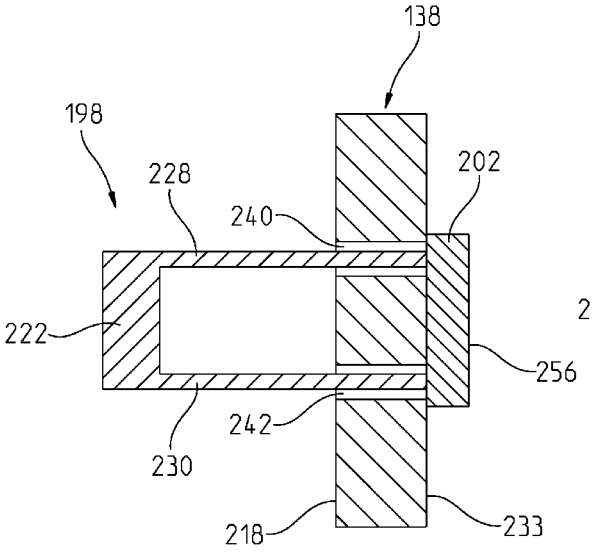
FIG. 9 is a side, sectional, greatly enlarged and somewhat schematic view of the magnet, base plate, and magnet mover of the recoil reducer of the present invention, shown in the rest position.

Alternately, a co-linear retaining mechanism, such as is shown in FIG. 9, can be used in place of the radially extending passageway 68 for retaining the shock absorber 54 and recoil reducer 11 in place. It is believed by the Applicant that the retaining mechanism shown in FIG. 9 is preferable to the one shown in FIG. 11 that employs retaining screws 70 and radial passageway 68.

Figure 15:
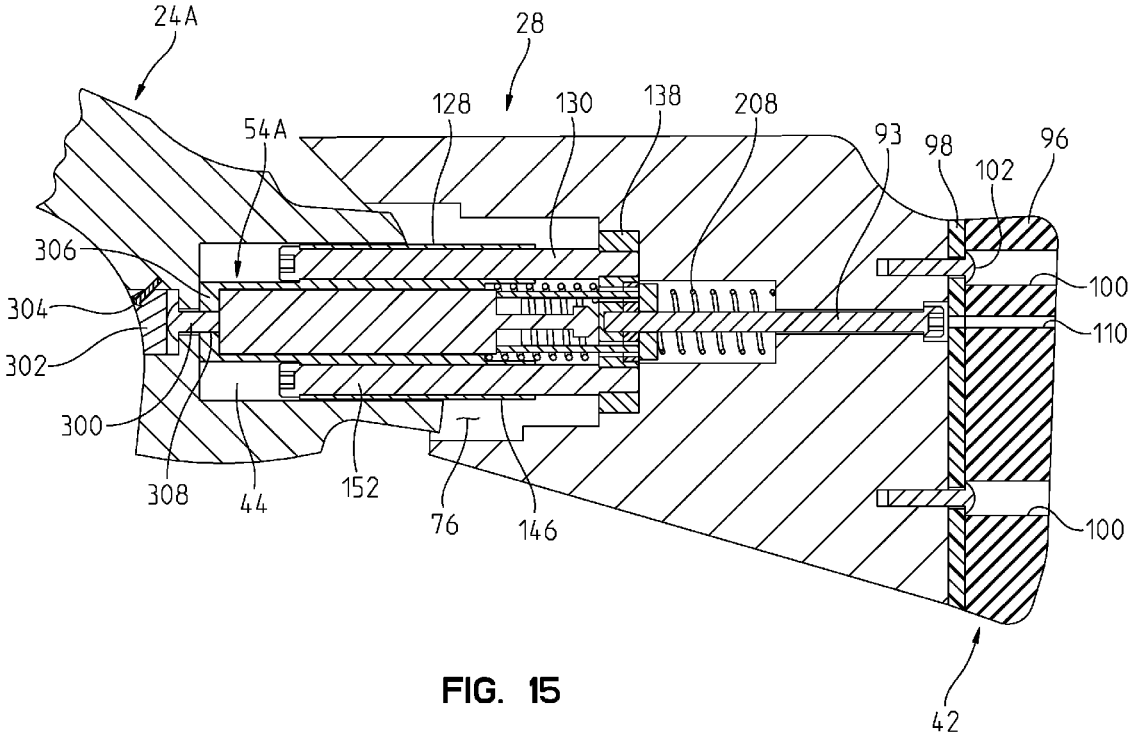
FIG. 15 is a sectional view similar to FIG. 7, showing an alternate embodiment of the present invention, featuring an inventive and modified stock-to-shock coupler.

The shock-to-stock coupler shown in FIG. 15 includes a bolt 300 that is threadedly engaged to a threaded blind aperture 308 in the proximal end 306 of shock absorber 54A's housing and is disposed co-linearly with the axis of the recoil reducer 11, including the axes of the shock absorber 54, shock absorber plunger 172, first spring 170, magnet 202, magnet mover 198, magnet retaining spring 208, and stock-to-base connector bolt 93. This co-linear coupling between the stock-to-shock coupler 300, recoil reducer 11 and stock-to-base coupler 93 helps to reduce variability and increase reliability of the recoil reducer, by focusing the recoil force along a single axis.

A recess is cut into the first stock 24A which, for aesthetic purposes is fitted with a formed plug 302, which is held in place with retaining screw 304 that extends through the plug 302 and stock 24.

Figure 7:
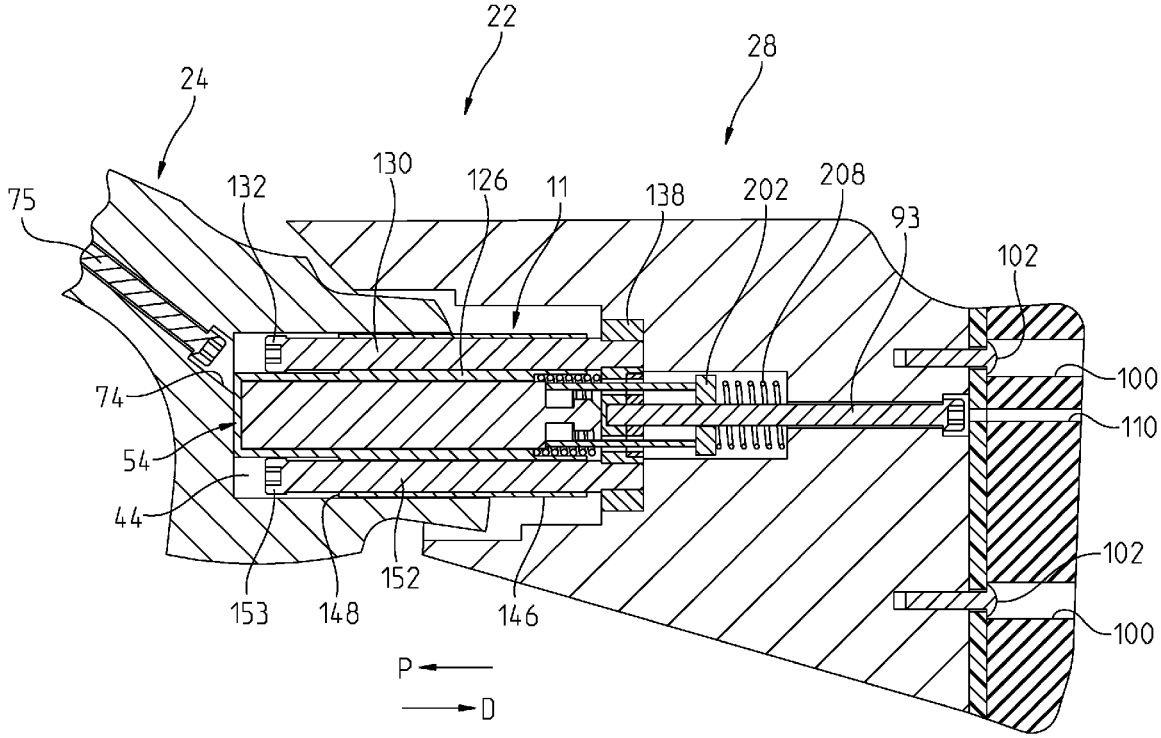
FIG. 7 is a sectional view, similar to FIG. 6, showing the stock and recoil reducer in the recoil position.
Figure 8:
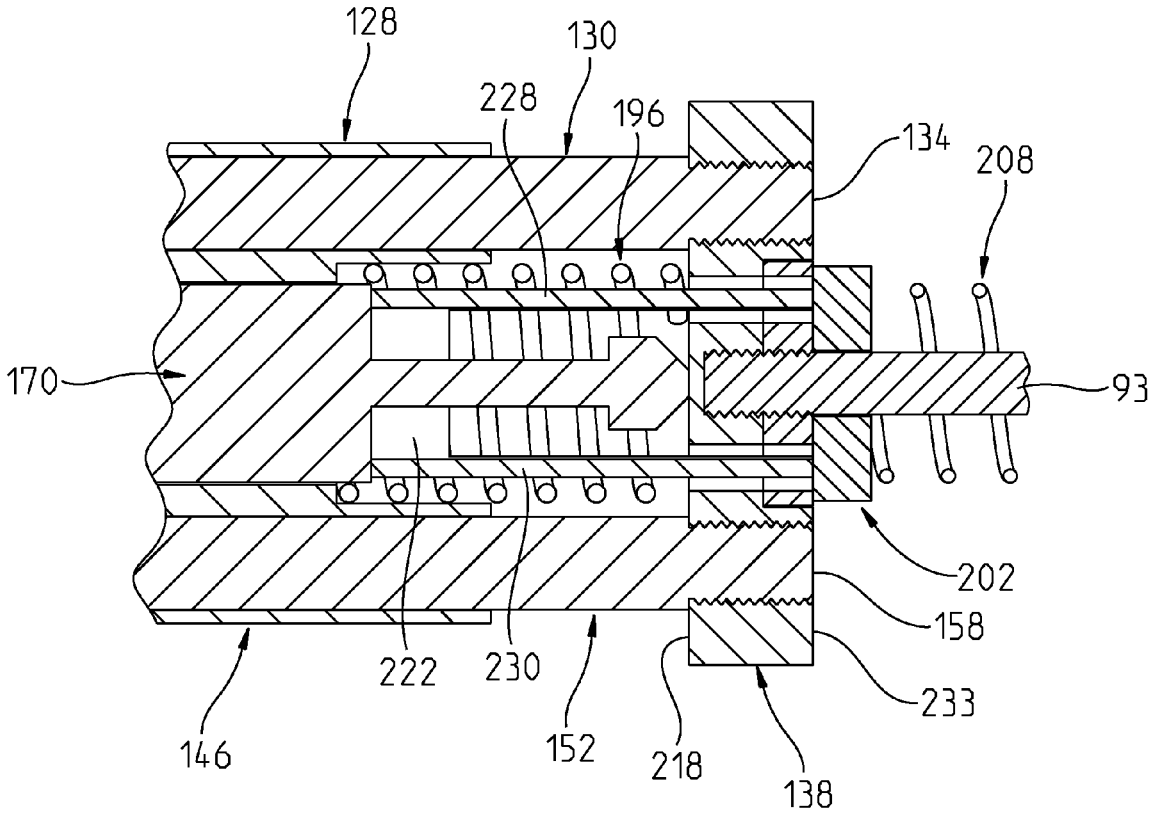
FIG. 8 is a sectional, greatly expanded view, showing the portion of the recoil reducer adjacent to the base plate and magnet.

Returning back to FIG. 3, an angled passageway 72 extends from the proximal wall 46 of the proximal cavity 44 in a proximal direction, that is angled from the axis of the recoil reducer 11. Angled passageway 74 is provided for receiving a stock-to-firing mechanism coupler 75, that can take the form of an Allen-headed bolt. Allen-headed bolt 75 is inserted into the passageway 74 with its tail end being threaded engaged with a threaded female member the firing mechanism of the rifle 10. Bolt 75 fixedly couples and positions the firing mechanism of the device to the first or proximal stock member 24, and hence, to the entire stock 22 (FIG. 7).

The second stock member 28 includes a proximally opening distal cavity 76, that is sized to be alignable and mateable with the proximal cavity 44 and the distal end 48 of the first stock member 24. The distal cavity 76 has several portions, with the portions being defined herein generally by the diameter of the particular portion. That is, although the cavity 76 is a unitary cavity, the cavity 76 has portions having different diameters that are designed for different purposes. These different portions include a proximally disposed enlarged first portion 78, that extends generally between the leading (proximal) edge 79 of the cavity 76, and terminates at radially extending step 81.

The first or proximal portion has the largest diameter of the passageway 76 and is sized for slideably receiving the distal portion 32 of the proximal stock member 24. As best shown in FIG. 1, the distal portion 32 of the proximal stock member 24 is interiorly and slideably received within the first or proximal portion 78 of cavity 76. The length of the first or proximal portion should be great enough so that the distal portion 32 of the proximal stock 24 can be received within the first portion 78 far enough so that the proximal portion 32 can be received in its rest position as shown in FIG. 1, and also in its recoil position as shown in FIG. 2.

It will be noted that the relative linear position of the radial wall 81 varies. For example, in FIG. 3, it will be noted that the portion of the radial wall 81 that is shown near the top cavity 76 is linearly positioned differently than the wall 81 portion near the bottom cavity 76. This difference in positioning is designed to accompany the fact that the distal edge 48 of the second stock member 24 is not planar, but rather, the bottom portion 48*a* of distal edge 48 extends rearwardly for a greater distance than the upper portion 48*b* of distal edge 48 of the proximal stock portion 24.

The second portion 80, has a relatively reduced diameter, when compared to the first portion 78. The second portion 80 is designed primarily for receiving the proximal ends of the slider and shock absorber of the recoil reducer 11.

The third portion 82 is defined as the portion between the second portion 80 and radially extending wall 86. The third portion 82 has a reduced diameter, when compared to the second portion 80, and is designed and sized to receiving the base plate 138 of the recoil reducer 11. As will be described in more detail below, the base plate 138 is one element of the recoil reducer 11, that remains fixedly positioned in one place during the operation of the recoil reducer 11, and during the movement of the recoil reducer 11 between its rest and recoil position.

The fourth or magnet and spring retaining portion 84 is disposed distally of the third portion 82 (which is itself disposed distally of the second portion 80, which is disposed distally of the first portion 78). The fourth portion 84 has a reduced diameter, relative to the second portion 82. The fourth, magnet and spring receiving portion 84 extends generally between the radially extending wall 86 that defines the distal extent of the third portion 82, and the radially extending wall 87, that defines the distal end of the fourth magnet receiving portion 84. The magnet and spring receiving portion 84, is generally cylindrical in shape, and has a diameter that is sized to receive a spring 208 and magnet 202. The diameter of portion 84 should be sized so that the diameter of the fourth portion 84 is slightly larger than the diameter of the spring 208 and magnet 202, but not too much greater. By having the diameter of the fourth portion 84 slightly larger than the diameter of the magnet 208 and the spring 202, the fourth portion 84 helps to maintain the magnet and the spring in their proper radial position, that thereby improves the operation of the device.

The fifth portion 90 of the distal cavity 76 extends from the radially extending wall 87, distally, to the distal end of the second stock portion 28, wherein it terminates in an enlarged, screw head receiving portion 89. The screw head retaining portion 89 is relatively enlarged, for receiving the screw head 91 that is attached to the shaft of the bolt-like stock-to-base connector rod 93. The distal end 95 of the stock-to-base member connector 93 is threaded, to threadedly engage a blind aperture 246 that is formed in the distal 233 surface of the base member 138.

Additionally, a pair of lined, threaded holes 106 extend axially proximally from the radially extending distal edge 106 of the second stock member 28. Threaded holes 106, are threaded to receive a pair of screws 102, that extend through passageways 100 that are formed in the rubberized shoulder cushion 42. A rubberized shoulder cushion 42 includes a relatively rigid base portion 98 having a radially extending proximally facing surface 99, that mates against the distally facing first surface 108 to mate the rubberized cushion 42 to the distal end of the second stock member 28. The base member 98 is relatively more rigid than the relatively less rigid shoulder cushioning member 96. The shoulder cushioning member 96 is preferably made of the same type of material that is generally used with such rubber cushioned materials of other common known prior art guns. The rubberized cushioned member 96 and base 98 include a pair of axially extending apertures 100 for receiving the threaded bolts 102, that are engagable with the threaded apertures 106, for fixedly securing the rubber cushion 142 to the distal end of the second stock member 28. Additionally, an axially extending aperture 110 is provided that is alignable with the engagement means of the screw head 91. Aperture 110 is sized to enable the user to extend a driver tool, such as an Allen wrench or screwdriver through aperture 110, to engage the Allan hole or screw slot of the screw head 91, to rotate the threaded connector 93, to engage and disengage the threaded proximal end 95 of the screw 93 to and from the threaded blind aperture 246, in the base plate 138 of the recoil reducer 11.

The recoil reducer 11 includes a shock absorber 54 that extends axially, and is centrally located within the cavities 44, 76 of the first and second stock members 24, 28 respectively. The shock absorber 54 includes a housing 129. Housing 129 extends axially along an axis that is generally parallel to the axis of the first slider 126 and a second slider 130. The first slider 126 includes a first slider member (slider tube) 128 that is fixedly coupled to a side surface of the shock absorber 54 housing 129, and includes an axially extending passageway 162 therein. The second slider member 130 of first slider 126 is slideably moveable with respect to the slider tube 128 and shock absorber 154, and is fixedly coupled to and fixedly positioned with regard to a base member 138. The slider tube 128 includes a proximal end 129 and a distal end 131. The proximal end 129 is disposed relatively closer to the proximal radially extending surface 56 of the first stock member 24.

Figure 4:
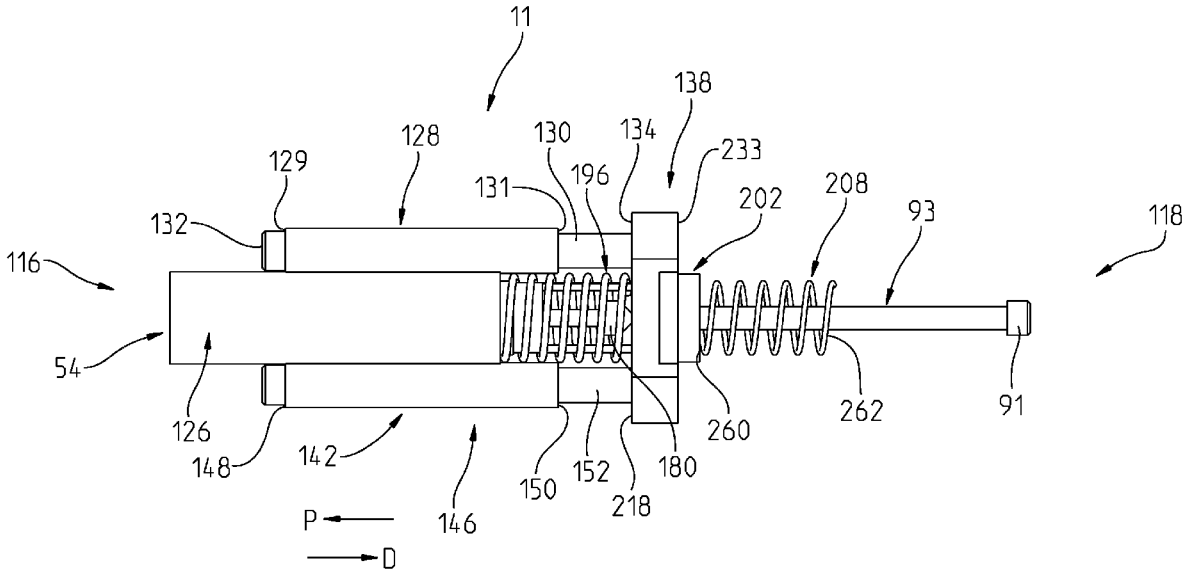
FIG. 4 is a side view of the recoil reducer mechanism of the present invention shown in its rest position.
Figure 5:
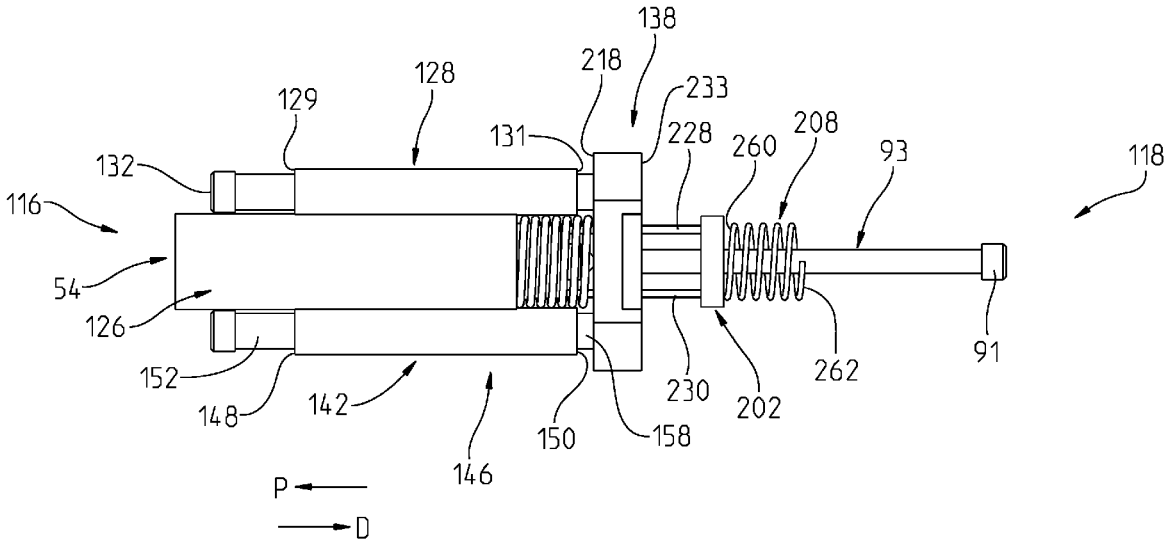
FIG. 5 is a side view, similar to FIG. 4, showing the recoil reducer in its recoil position.

As best shown in FIGS. 3-5, the slider shaft member 130 of the first slider 126 also includes a proximal end 132 and a distal end 134. The slider shaft member 130 comprises a bolt-like cylindrical shaft, wherein the proximal end 132 is formed to receive a driving tool. For example, the proximal end 132 can be formed to include a slot for receiving a head of a slot-type screwdriver; or containing a hex-shaped recess for receiving an Allan wrench-type driver. The distal end 134 is threaded for threadedly engaging a corresponding lead positioned aperture on the base 138.

The slider shaft 130 of the first slider 126 is sized to have a length generally longer than the slider tube member 128, and to have a diameter slightly smaller than the slider tube 128, so that the slider shaft 130 can slide axially within the slider tube 128 and can be interiorly received by the slider tube 128.

The second slider 142 is generally similar to the first slider 126, and has an axis that is disposed generally parallel with the axis of the shock absorber 54, and the axis of the first slider 126. Second slider 142 includes a first slider member (slider tube 146), that is generally similar in configuration to the corresponding slider tube 128 of the first slider 126. Slider tube 146 includes a proximal end 148 and a distal end 150. Similarly, a second slider member (slider shaft) 152 of the second slider 142 is provided that includes a proximal end 153 that is formed to be a tool receiving head, and a threaded distal end 158 that is threaded to be threadedly engaged with a corresponding aperture 236 of the base member 138.

In operation, the slider operates such that the slider tubes 128, 146 are fixedly positioned with respect to the shock absorber housing 126, and are fixedly positioned with respect to the first stock member 24. The slider tubes 128, 146 are fixedly positioned to the first stock member 24, by virtue of their fixed coupling to the shock absorber housing 126, which itself is fixedly coupled to the first stock housing 24 via retaining screws 70 (or retaining screw 300 (FIG. 15). However, the first and second shock absorber slider receiver tubes 128, 146 and shock absorber housing 126 are movable with respect to the second stock housing 28.

In contrast, the second slider members (threaded shafts 130, 152) are movable with respect to the slider tubes 128, 146 and shock absorber housing 126. When the recoil reducer 11 moves between its rest position (FIG. 4) and its recoil position (FIG. 5), the first and second slider shafts 130, 152 move axially with respect to the slider tubes 128, 146. Notwithstanding this, the first and second slider shafts 130, 152 are fixedly coupled and fixedly positioned with respect to the second stock member 28, by virtue of the fixed coupling and positioning between the shaft members 130, 152 and the base 138; and the fixed coupling between the threaded apertures 234, 236 of the base 138 and the stock 28 via the stock-to-base connector 93, that fixedly couples the second stock member 28 to the base 138.

The shock absorber housing 126 is provided for housing a removable and replaceable shock absorber 170, that is sized and configured to be interiorly received within the interior passageway 171 of the shock absorber housing 126. The shock absorber member 170 includes a casing 174 that is generally cylindrical in configuration, and a piston rod 176 that extends distally out of the casing 174 and is axially movable with respect to the casing 174. The piston rod 176 includes a distal end 178, that comprises an enlarged, base-engaging head member 178. A piston head 184 is disposed at the proximal end of the piston rod 176, and is contained within the interior of the casing 174.

As will many hydraulic cylinders, such as shock absorber 170, the piston head 184 usually includes one or more axially extending passageways, so that fluid can travel through the piston head 184. A return spring 188 is provided for biasing the piston head 184, and hence the entire piston assembly 172 in a distal direction, which is the direction corresponding to the rest position of the recoil reducer and indicated generally by arrow D in FIG. 4.

As best shown in FIGS. 3-5 and 9-10, the recoil reducer 11 also includes a first spring 196, a magnet mover 198, base member 138, magnet 202 and magnet engaging spring 208.

The first spring 196 includes a first or proximal end 208, and a second or distal end 214. The first end 208 is configured and positioned for being received on a radially extending, axially distally facing surface of the distal surface 210 of the shock absorber 154, which serves as a spring seat for the spring 196. The second spring end 214 of the spring 196 is sized and positioned for engaging the radially extending, axially proximally facing surface 218 of base 138. The first spring 196 extends between the shock absorber 54 and the base 138, and is biased outwardly to urge the shock absorber housing 126 in a proximal direction, away from the base 138. In so doing, the action of spring 196 helps to move the recoil reducing device 11 toward its rest position, as shown in FIG. 4. When the recoil reducing device 11 is in its recoil position as shown in FIG. 5, the expansion of spring 196 moves the recoil reducing device 11 back to the rest position as shown in FIG. 4.

The magnet mover 198 is axially moveable with respect to the base member 138, and is provided for dislodging the magnet 202 from its engagement with distal surface 233 of the base member 138, when the recoil reducer 11 begins its travel from its rest position (FIG. 4) to its recoil position (FIG. 5). The magnet move 198 includes a ring-like, proximally disposed shock absorber engaging portion 222 that is sized and configured for engaging either the housing 126 of the shock absorber 54, or the generally stationary casing 170 of the shock absorber 54. The diameter of the magnet mover 198 is sized so that it is small enough to be interiorly received within the coils of the spring 196. This interior reception also helps to maintain the magnet mover 198 in a properly oriented position.

The magnet mover 198 includes a pair of axially extending legs 230, 228 that are sized and positioned for being interiorly received by a pair of non-threaded apertures 240, 242 respectively, that extend axially through the base 138. When in the rest position, the distal ends of the leg 228, 230 should be axially positioned in the apertures 240, 242, and adjacent to the distally facing surface 233 of the magnet 202.

Figure 10:
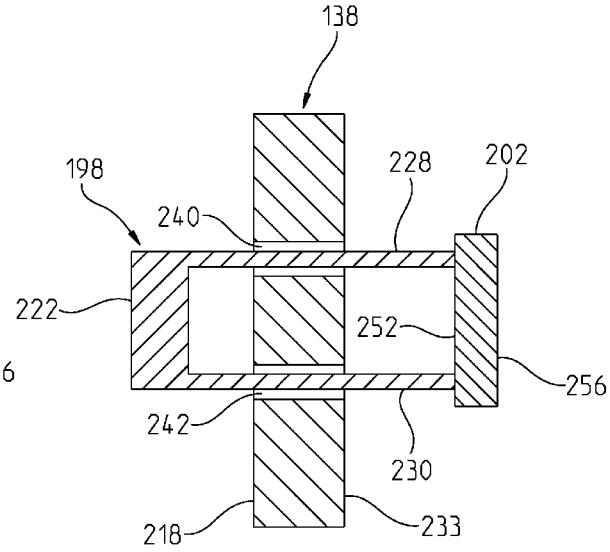
FIG. 10 is a schematic view similar to FIG. 9, showing the magnet mover, base plate and magnet in the recoil position.

As shown in FIG. 10, the first and second axially extending legs 228, 230 of the magnet mover 198 extend all the way through the non-threaded apertures, 240, 242 when the device is in its recoil position as shown in FIG. 10, to a position wherein the distal ends of the magnet mover have moved the magnet 202 a significant distance away from the axially distally facing surface 233 of the base 138.

As alluded to above, base 138 includes a radially extending, axially proximal facing surface 218, and a radially extending, axially distally facing surface 233. An axially extending threaded aperture 234 extends axially through the base member 138, and is threaded for receiving the threaded distal end 134 of the first slider shaft member 130. Similarly, second slider shaft 152 receiving aperture 236 extends axially, and is threaded for receiving the distal end 158 of the second threaded slider shaft 152.

Disposed radially inwardly of the threaded apertures 234, 236 are a pair of non-threaded apertures 240, 242. The non-threaded apertures are provided for slideably receiving the axially extending legs 228, 230 of the magnet mover 198.

An axially outwardly facing blind threaded aperture 246 is formed in the distally facing surface 233 of the base 138. This centrally disposed aperture 246 is threaded for receiving the threaded distal end 95 of the stock-to-base member bolt-like connector 93. The engagement of the bolt-like connector 93 with the base 138 fixedly couples the base 138 to the second stock member 28, and fixedly positions the base 138 with respect to the respective stock member 28, so that there should be no relative movement between the second stock member 98 and the base 138.

The magnet 202 generally has the shape of a thickened washer (or half of a sliced bagel), and includes a central aperture 258 at the center of the magnet 202, that extends axially therethrough. The central aperture 258 is sized and positioned for receiving the shaft of the stock-to-base connector 93, so that the magnet 202 can slide axially along the shaft of the stock-to-base connector 93. The magnet 202 should have a sufficient radial extent, so that it extends radially outwardly past apertures 240, 242, so that the axially extending legs 228, 230 may engage the proximally facing surface of magnet 202 to move it. The magnet includes a proximal facing surface 252 and a distal facing surface 256.

The proximal facing surface 252 engages the distal facing surface 233 of the base plate. When so engaged, a magnetic attraction should exist between the magnet 202 and the base plate 138. If the base 138 is made from a ferrous material, this magnetic attraction will exist because of the attraction between the magnet 202 and the magnetizable base 138. However, the Applicants have found that aluminum is often preferred to be used for the base 138. In such cases, a magnetizable plate, such as magnetizable plate 248, can be coupled to the distal surface 233 of the base 138 so that the magnet 202 can become magnetically engaged to the base 138.

The magnet return spring 208 includes a first or proximal end 260, that engages the distal surface 256 of the magnet, and a distal end 262 that engages the radially extending wall 87 of the spring and magnet receiving portion 84 of the second cavity 76.

It will also be noted that the diameter of the magnet 202 and spring 208 is configured so that they will be interiorly received within passageway 84, and so the diameter of the magnet and spring 208 is slightly less than the passageway portion 84, so that the side walls of the passageway portion can help to axially align the magnet and spring.

The operation of the device can best be understood with reference to FIGS. 1-7 and 15.

Figure 6:
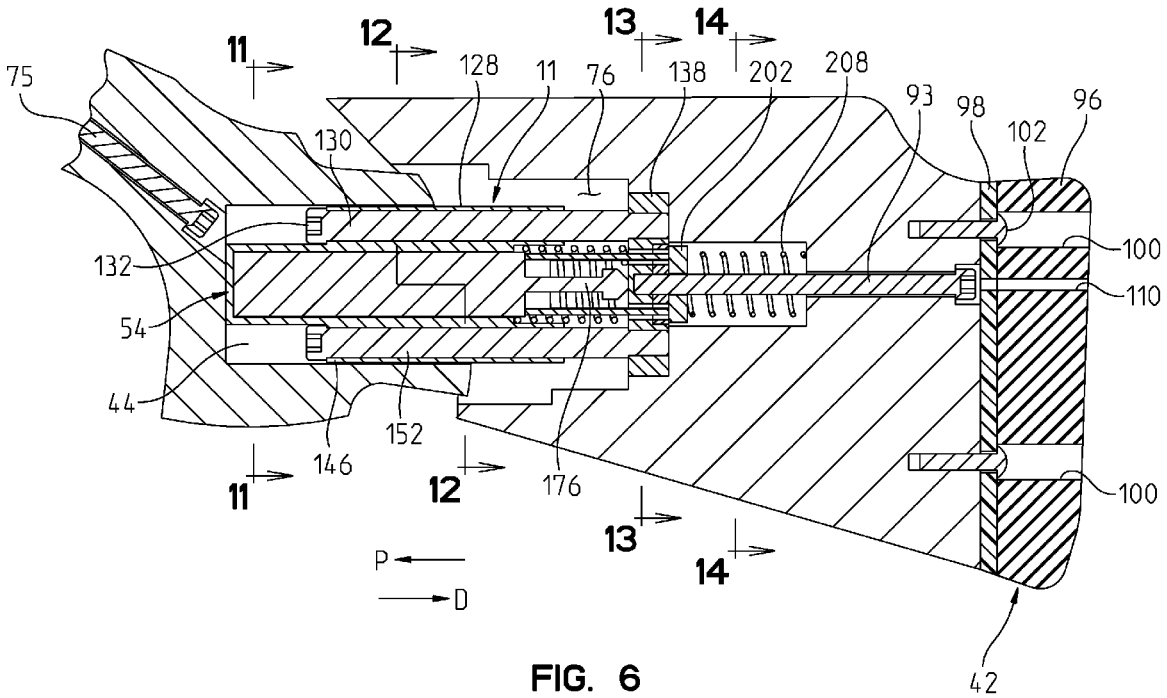
FIG. 6 is a side sectional view of the assembled stock and recoil reducer, shown in its rest position.

Normally, the first and second stock members 24, 28, and the recoil device 11 will be in the rest position as shown in FIG. 6. In the rest position, the distal end 48 (FIG. 3) of the first stock member 24, is received only a small distance into the interior of the second cavity 76. In the preferred embodiment shown in FIG. 15, it will be noted that the axis of the stock-to-shock absorber coupler 300, shock absorber 54A, shock absorber plunger 176, the base plate 138, and the second stock member-to-base plate coupler 93 are all co-axially aligned with each other.

The user can move the device from its rest position FIG. 6 to its recoil position FIG. 7, by placing the rubber cushion 96 against the user's shoulder, and grabbing the first stock member 24, and pulling the first stock member 24 toward his shoulder, in a direction indicated as generally being a distal direction D in FIG. 7.

This movement to the recoil position can also occur due to the discharge of a bullet, wherein the recoil force of the exploding bullet pushes axially along the axis of the recoil device 11 in a distal direction D, to compress the first stock member 24 with respect to the second stock member 28. When in the recoil position, as shown in FIG. 7, the distal end 48 of the first stock member 24 is received a greater distance into the interior cavity 76, so that the distal surface 48 is close to, if not engaging, the radially facing surface 81. Additionally, the plunger 176 is relatively compressed, as is first spring 196. Additionally, the second, or magnet return spring 208 is also relatively compressed.

To move back to the rest position, the first spring 196 expands to its rest position, that moves the first stock member 24 in a proximal direction P, relative to the second stock member 28. Additionally, the second spring 208 returns to its expanded rest position.

When in the rest position, the magnet 202 engages the distally facing surface 233 of the base 138. As the base 138 is fixedly coupled to both slider screws 130, 152 and the stock-to-base connector 93, the base member 138 generally does not move position during the movement of the device between its rest and recoil positions.

To move the device 11 from the rest to the recoil position, the force that must be overcome, is the expansion-biased force exerted by the shock absorber 54, and the first 196 and second spring 208, all of which are biased to normally move to work against a distally directed recoil force, to normally move the first stock member 24 into the rest position.

In addition to these forces, an additional force that must be overcome is the attractive force of the magnet 202 to the base 138.

Disposed adjacent to the proximal surface of the magnet 202, are the distal ends of the legs 228, 230 of the magnet mover 198.

As the device 11 first begins its movement from the full rest to the recoil position, the device 11 must overcome the magnetic force of attraction between the magnet 202, and the ferrous plate of the base member 138. As will be appreciated by those familiar with magnetics, the force that must be overcome to move the magnet 202 decreases as the magnet moves away from the base plate 138 and is at its strongest when the magnet 202 and base plate 138 are engaged to each other. When the device is in its full recoil position as shown in FIG. 7, the magnet 202 is spaced a significant distance from the base plate 138. The primary impact of the magnetic engagement between the base plate 138 and the magnet 202, is to help to hold the device in the full rest position.

When a shooter is holding and aiming the gun in preparation of shooting the gun, it might be natural for the user to exert some distally directed force on the first stock member 24. This distally directed force serves to move the first stock member 24 with respect to the second stock member 28. Such movement could add an element of variability that would reduce the repeatability of the user's ability to shoot, and thereby impact the accuracy of the shot. As such, the magnet 202 should engage the base plate 138 with a significant amount of magnetic force, so as to maintain the first stock member 24 and second stock member 58 in a semi-fixed position with respect to each other, at least to the extent necessary to restrict movement in response to the typical distally directed force exerted by the user on the first stock member when the user is aiming the gun. Nonetheless, the magnet 202 should not necessarily lock the first and second stock members 24, 28 with respect to each other, so that a discharge of the firearm is required to allow the two to move together.

After the gun has been discharged, and the force of the recoil has been spent, the second spring 208 will expand outwardly to its rest position, to urge the magnet 202 back into engagement with the base 138. Similarly, first spring 196 will expand to its rest position, to help move the housing 170 of the shock absorber in a distal direction, and back to the rest position. Additionally, the engagement of the proximal facing surface 252 of the magnet 202 with the distal ends of the legs 228, 230 of the magnet mover 198, will move the magnet mover in a proximal direction back to its rest position, as is shown in FIG. 6.

Having described the invention in detail with reference to certain preferred embodiments, it will be appreciated that variations and modifications exist, with the invention being limited only by the claims, and the allowable equivalents thereof.

What is claimed is:

1. A recoil reducer device for use with a firearm, and movable between a rest and a recoil position, the recoil reducer device comprising a firearm stock including a first stock member having a first stock member cavity, and a second stock member having a second stock member cavity, and a recoil reducer receivable in the first and second stock cavities, the recoil reducer including (a) a shock absorber including a housing and an axially movable plunger member;

(b) a slider including a first slider member fixedly coupled to the shock absorber, and a second slider member movable with respect to shock absorber and first stock member, (c) a base member fixedly coupled to the second slider member; and (d) a magnet magnetically coupled to the base member.

2. The recoil reducer device of claim 1 further comprising a stock-to-shock coupler for removably fixedly coupling the first stock member to the shock absorber to fixedly position the shock absorber housing with respect to the first stock member when the recoil reducer moves between its rest and recoil positions.

3. The recoil reducer device of claim 2 wherein the first stock member includes a passageway axially aligned with an axis of the shock absorber, and the stock-to-shock coupler comprises a stock-to-shock fastener insertable in the passageway and engagable with the shock absorber to fixedly couple the first stock member to the shock absorber, wherein the stock-to-shock fastener includes an axis disposed generally colinear with an axis of the shock absorber and the recoil reducer.

4. The recoil reducer device of claim 1 further comprising a magnet mover positioned between the shock absorber and the magnet, the magnet mover being movable to dislodge the magnet from its magnetic engagement with the base member when the recoil reducer moves from its rest position toward its recoil position.

5. The recoil reducer device of claim 4 further comprising a first spring member sized and positioned for interiorly receiving the magnet mover, and extendable between the shock absorber and the base.

6. The recoil reducer device of claim 4 further comprising a first spring member having a first end for engaging the shock absorber and a second end for engaging the base member, the first spring member being biased to absorb energy as the recoil reducer moves from its rest to its recoil position, and to urge the recoil reducer into its rest position.

7. The recoil reducer device of claim 6 further comprising a second spring member for biasing the magnet member into engagement with the base member.

8. The recoil reducer device of claim 7 wherein the first and second spring members are disposed coaxially with each other and also with the shock absorber, the magnet mover and a stock-to-base coupler.

9. The recoil reducer device of claim 7 further comprising a first spring member having a first end for engaging the shock absorber and a second end for engaging the base member, the first spring member being biased to absorb energy as the recoil member moves from its rest to its recoil position, and to urge the recoil reducer to its rest position.

10. The recoil reducer device of claim 1 wherein the magnet and magnet mover are cooperatively positioned to disengage the magnet from the base member as the recoil device begins its movement away from the rest position.

11. The recoil reducer device of claim 10 wherein the magnet mover includes a shock absorber engaging portion and at least one axially extending leg, and the base member includes an aperture for receiving the at least one axially extending leg, the aperture being positioned for permitting the at least one axially extending leg to pass through the base member and engage the magnet for dislodging the magnet from the base when the recoil reducer moves from its rest to recoil position.

12. The recoil reducer device of claim 11 wherein the shock absorber engaging portion of the magnet mover engages the housing of the shock absorber and moves with the housing of the shock absorber and moves relative to the base member and the shock absorber plunger.

13. The recoil reducer device of claim 12 wherein the base member includes a first axially facing surface and a second axially facing surface, and wherein the plunger of the shock absorber engages the first axially facing surface of the base member and the magnet engages the second axially facing surface and the base member.

14. The recoil reducer device of claim 1 further comprising a second spring member extendable between the magnet and the second stock member for urging the magnet into engagement with the base member.

15. The recoil reducer device of claim 1 further comprising a stock-to-base coupler for fixedly coupling the base member to the second stock member for fixedly positioning the base member and the second stock member to prevent movement of the second stock member relative to the base member.

16. The recoil reducer device of claim 1 further comprising a second spring member extendable between the second stock member and the magnet, wherein the magnet includes a central aperture, and the stock-to-base coupler comprises a rod-like member that extends through and is disposed coaxially with the aperture of the magnet and the second spring member.

17. The recoil reducer device of claim 16 wherein the second spring member urges the magnet into engagement with the base plate, and further comprising a first spring member extendable between the base member and the shock absorber for resisting movement of the recoil member from the rest position to the recoil position, and for urging the recoil reducer into its rest position.

18. The recoil reducer device of claim 17 wherein the cavity of the second stock member includes an axially facing wall for serving as a distal seat for the second spring member, and wherein the first spring member and shock absorber are disposed coaxially with the magnet member and second spring member.

19. The recoil reducer device of claim 1 wherein the base member includes a proximally disposed axially facing surface, and wherein the plunger of the shock absorber engages the axially facing surface of the base member for absorbing force generated by relative movement between the base and shock absorber caused by a discharge of the firearm.

20. The recoil reducer device of claim 1 wherein, the second stock member is fixedly positioned with respect to the base member, and the shock absorber housing is fixedly positioned with regard to the first stock member and movable with respect to the shock absorber plunger, the base member and the magnet, wherein movement of the base member relative to the shock absorber causes the shock absorber plunger to move relative to the shock absorber housing to thereby absorb force from the movement, and to dislodge the magnet from its magnetic engagement with the base member.

* * * * *